United States Patent [19]

Tachikawa et al.

[11] Patent Number: 4,643,238

[45] Date of Patent: Feb. 17, 1987

[54] VENETIAN BLIND

[75] Inventors: Takeyoshi Tachikawa, Yokohama; Shigeo Ohkubo, Misato, both of Japan

[73] Assignee: Tachikawa Corporation, Tokyo, Japan

[21] Appl. No.: 779,614

[22] Filed: Sep. 25, 1985

Related U.S. Application Data

[63] Continuation of Ser. No. 531,487, Sep. 12, 1983, abandoned.

[51] Int. Cl.[4] ..... E06B 9/30

[52] U.S. Cl. ..... 160/168 R; 160/177; 160/178 R

[58] Field of Search ..... 160/168, 178, 177, 23, 160/26, 354

[56] References Cited

U.S. PATENT DOCUMENTS

| | | | |
|---|---|---|---|
| 2,412,583 | 12/1946 | Jablin | 160/168 |
| 2,698,727 | 1/1955 | Rutledge | 160/178 R |
| 3,050,742 | 8/1962 | Munson | 160/23 R |
| 3,129,751 | 4/1964 | Weber | 160/354 |
| 3,158,195 | 11/1964 | Ney | 160/26 |
| 3,292,685 | 12/1966 | Clark | 160/26 |
| 3,447,585 | 6/1969 | Lorentzen et al. | 160/178 R |
| 3,809,143 | 5/1974 | Iyekgil | 160/168 |
| 3,818,543 | 6/1974 | Baker, Sr. | 160/345 |
| 4,282,919 | 8/1981 | Teno | 160/23 R |
| 4,333,510 | 6/1982 | Fox | 160/177 |
| 4,425,956 | 1/1984 | Terlecke | 160/168 R |

FOREIGN PATENT DOCUMENTS

| | | | |
|---|---|---|---|
| 1173345 | 8/1984 | Canada | 160/177 |

OTHER PUBLICATIONS

Japanese Official Gazette Publication Nos. 44-10608, 33-4740, 32-14070.

*Primary Examiner*—Reinaldo P. Machado
*Attorney, Agent, or Firm*—Leydig, Voit & Mayer

[57] ABSTRACT

A venetian blind includes a multiplicity of horizontal slats arranged in vertically spaced relation below a head box. The head box is of a rectangular tubular construction composed of elongate support and cover bars. The support bar includes at least a front side wall and a lower wall, and the cover bar is attached to the support bar in covering relation to an open side of the support bar. The head box accommodates therein a slat tilt adjustment device for adjusting the angle of tilt of the slats.

18 Claims, 32 Drawing Figures

VENETIAN BLIND

This application is a continuation of application Ser. No. 531,487, filed 9-12-83, now abandoned.

BACKGROUND OF THE INVENTION

1. Field of the Invention

The present invention relates to a venetian blind.

2. Description of the Prior Art

As shown in FIG. 31 of the accompanying drawings, prior venetian blinds have mainly incorporated a head box 111 having a substantially channel-shaped cross section. Since the conventional head box has an upper open side that is relatively small, various devices such as a slat tilt adjustment device M cannot easily be housed into the head box through the upper open side during assembly. The prior head box is also disadvantageous in that dirt, dust or other foreign matter tends to be trapped into the head box through the upper open side.

SUMMARY OF THE INVENTION

It is an object of the present invention to provide a venetian blind having a head box constructed to allow various devices such as a slat tilt adjustment device to be easily installed in the head box and to prevent dust, dirt or other foreign matter from entering the head box.

Another object of the present invention is to provide a venetian blind having a slat lift cord that can be operated obliquely downwardly of a head box.

Still another object of the present invention is to provide a venetian blind having a slat lift cord and ladder cords having upper ends attached to a support shaft of a slat tilt adjustment device, the upper ends being easily insertable through holes defined in a head box bottom, so that a multiplicity of slats attached to the ladder cords can efficiently be assembled on the head box.

Still another object of the present invention is to provide a venetian blind having a slat tilt cord which can easily be attached to a support member of a slat tilt adjustment device even after the slat tilt cord has been inserted through a hole in a head box, thereby allowing a multiplicity of slats to be assembled efficiently on the head box.

A still further object of the present invention is to provide a venetian blind having no brackets for supporting a head box and including a cover bar that can easily be attached to a support bar.

A still further object of the present invention is to provide a venetian blind including plugs which can easily be attached to ends of a head box and is prevented from being easily detached from the head box ends.

According to the present invention, there is provided a venetian blind comprising a head box having a rectangular tubular cross section composed of an elongate support bar including at least a front side wall and a lower wall and having an open side, an elongate cover bar attached to the support bar with a plurality of interfitting joints in covering relation to the open side of the support bar, a multiplicity of horizontal slats arranged in vertially spaced relation and positioned downwardly of the head box, and a slat tilt adjustment device accommodated in the head box for adjusting the angle of tilt of the slats. The support and cover bars are substantially L-shaped in cross section and assembled together in mutually inverted relation. The support bar may be channel-shaped in cross section and have an open rear side, and the cover bar may be a plate covering the open rear side. The slat tilt adjustment device comprises a plurality of support members disposed in the head box and spaced from each other longitudinally of the head box, an elongate rotatable drive shaft extending between and having portions journalled by the support members, and a plurality of support shafts mounted on the drive shaft at the portions and interposed between the drive shaft and the support members. With this arrangement, the head box can easily be assembled and the slat tilt adjustment device can be disposed in the head box as assembled with utmost ease. No dirt, dust or other foreign matter will enter the head box as assembled.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

A venetian blind according to an embodiment of the present invention will be described with reference to FIGS. 1 through 18.

Figure 1:
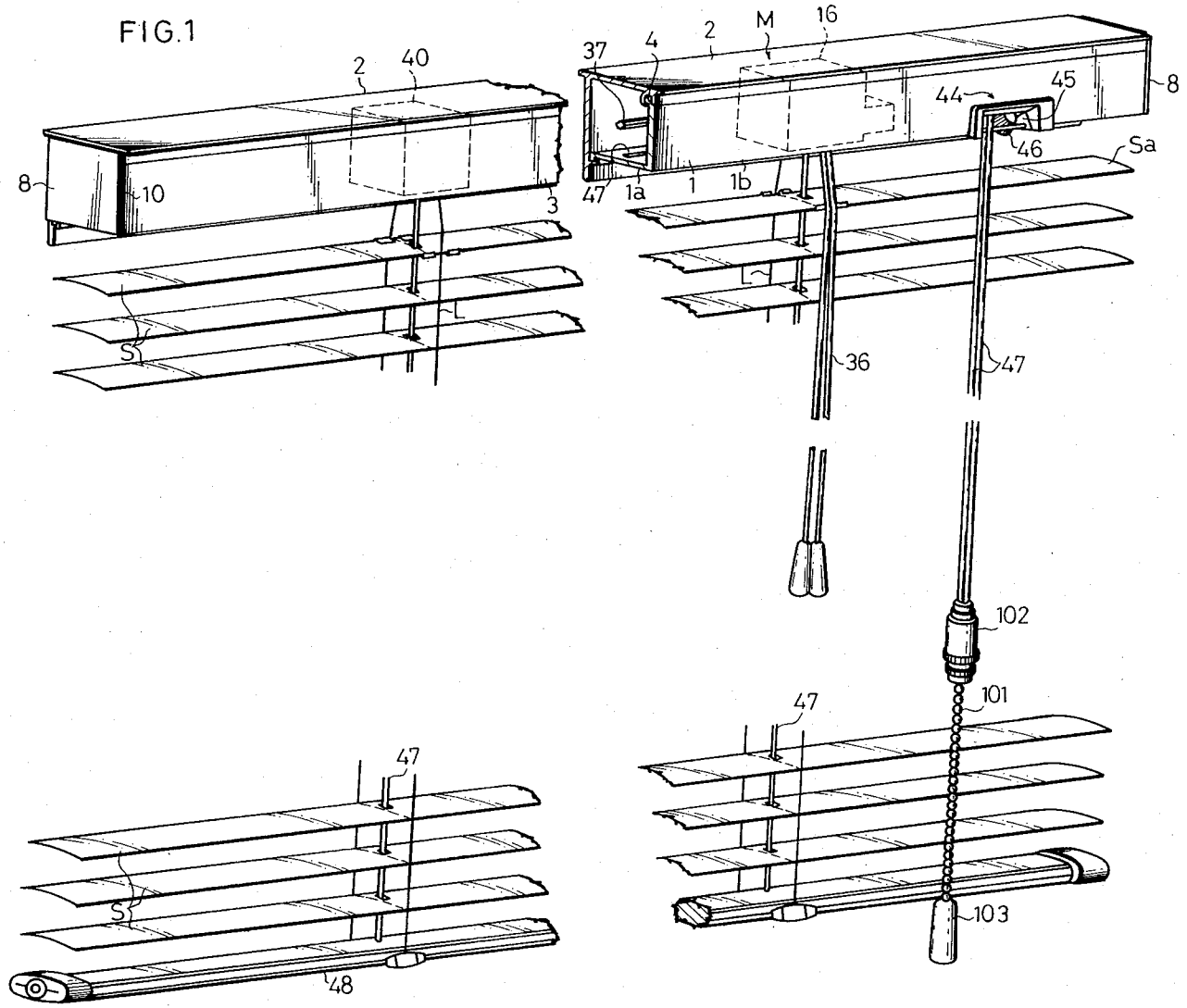
FIG. 1 is a fragmentary perspective view of a venetian blind according to the present invention.
Figure 14:
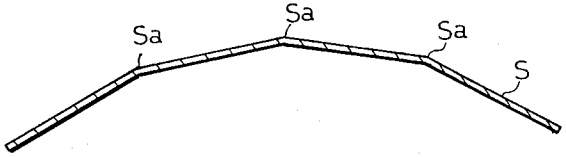
FIG. 14 is a cross-sectional view of a slat.
Figure 17:
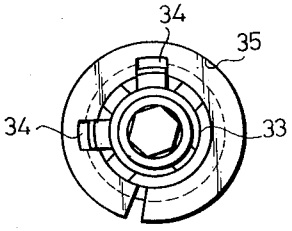
FIG. 17 is a side view of FIG. 15.

As shown in FIG. 1, the venetian blind has a multiplicity of horizontal slats S supported by two ladder cords L having upper ends supported on a slat tilt adjustment device M disposed in a head box 3 of the venetian blind. As illustrated in FIG. 14, each of the slats S is substantially arcuate in cross section and have three longitudinal folds Sa for increased stiffness to prevent the slats S from flexing between the ladder cords L.

The slat tilt adjustment device M, the structure of the head box 3, and an attachment construction for the slat tilt adjustment device M will now be described in detail.

Figure 4:
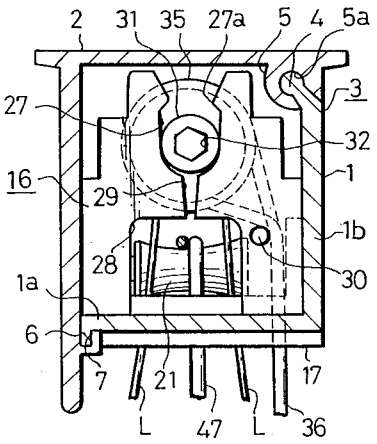
FIG. 4 is a side elevational view of the support member of FIG. 2 as mounted in the head box.

As best shown in FIGS. 1 and 4, the head box 3 is square-shaped in cross section and comprises a support bar 1 and a cover bar 2 which are both L-shaped in cross section and confront each other. The support bar 1 includes a front side wall 1*b* having along an upper edge thereof a longitudinal cylindrical ridge 4 fitted in a groove 5*a* in a substantially cylindrical tubular engagement ridge 5 formed on a front edge of an upper wall 1*c* of the cover bar 2. The support bar 1 also includes a lower wall 1*a* having along a rear edge thereof a lower longitudinal ridge 6 projecting downwardly and fitted in a lower channel-shaped groove 7 opening inwardly and formed along a lower edge of a rear side wall of the cover bar 2.

Figure 12:
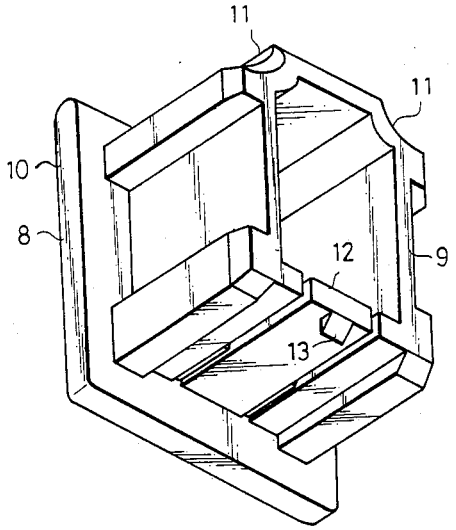
FIG. 12 is a perspective view of a plug to be attached to an end of the head box.
Figure 13A:
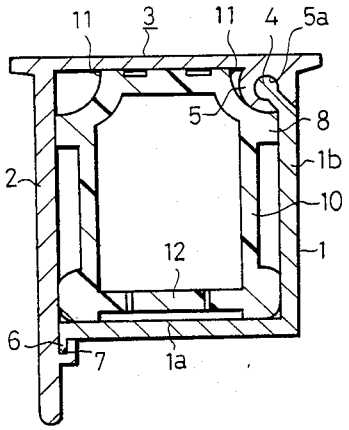
FIGS. 13A and 13B are cross-sectional views of the plug of FIG. 12 as attached to the head box end.
Figure 13B:
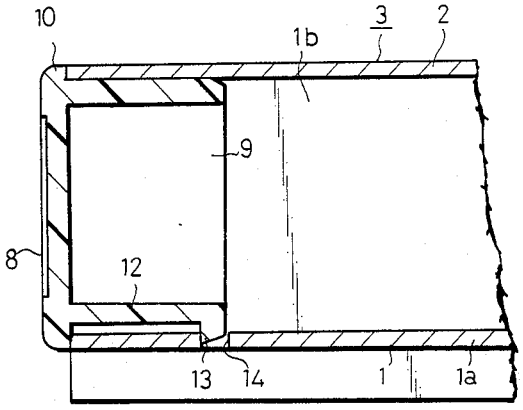

A plug 8 of synthetic resin is fitted in each end of the head box 3. As shown in FIGS. 12, 13A and 13B, the plug 8 is composed of a hollow square insert 9 inserted in the end of the head box 3 and a flange 10 disposed on an outer end of the insert 9 and engaging the end of the head box 3. In FIG. 13A, the insert 9 has recesses 11, 11 defined in an upper wall thereof at opposite edges, one of the recesses 11 engaging an inner surface of the ridge 5 of the cover bar 2. The insert 9 has a lower wall including a tongue 12 having a projection 13 formed on a lower surface at a distal end thereof and engaging in a locking hole 14 defined through the upper wall 1*a* of the support bar 1. Thus, the plug 8 once inserted in the end of the head box 3 is prevented from being disengaged from the head box 3.

Figure 6:
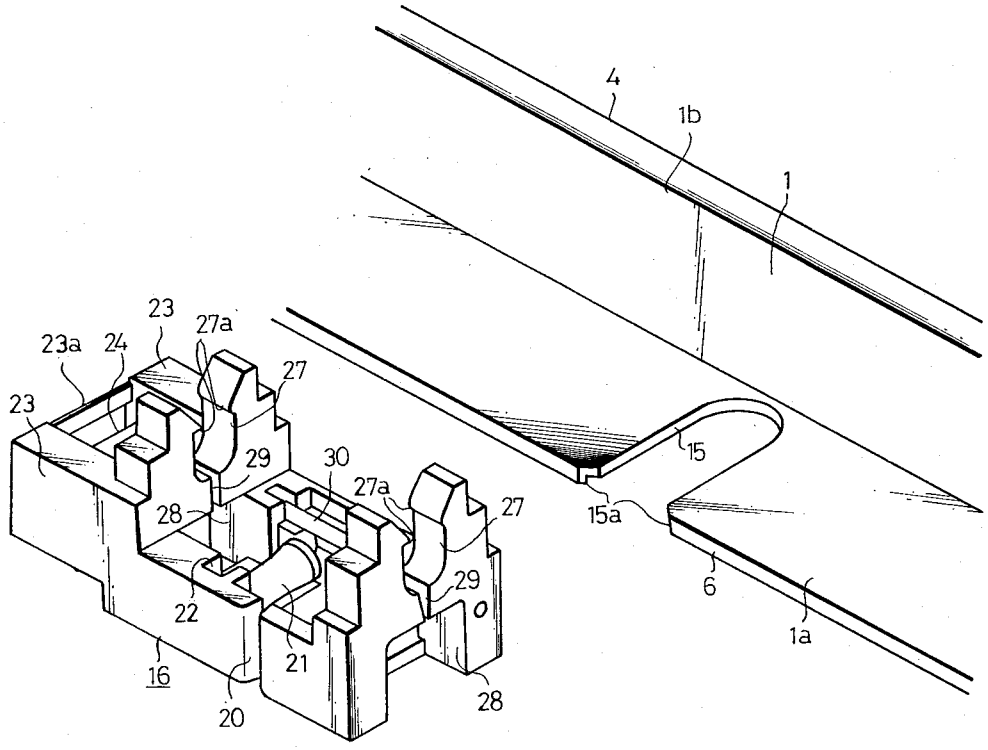
FIG. 6 is an exploded rear perspective view of the support member and a support bar shown in FIG. 2.
Figures 9, 10, 11:
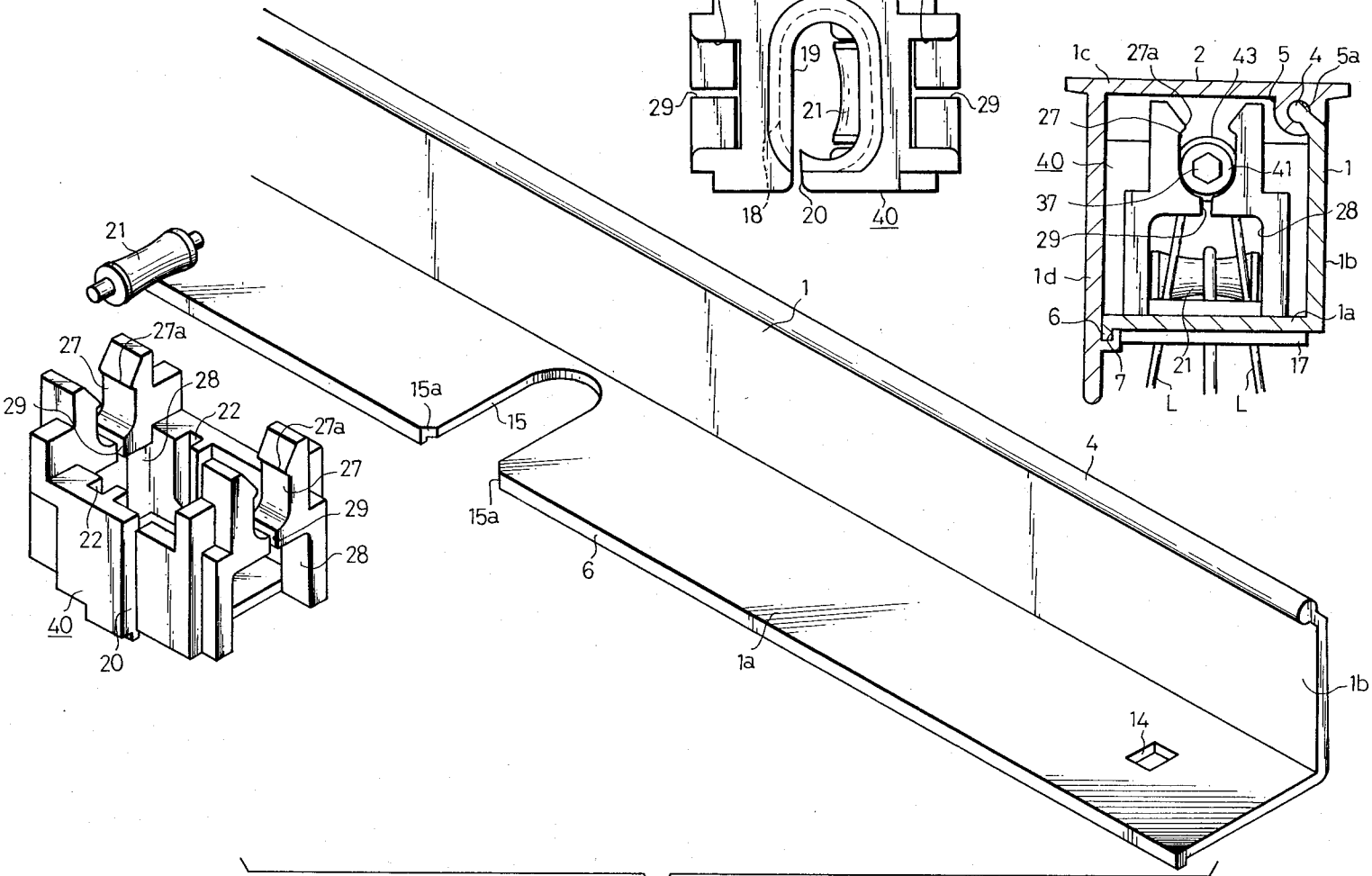
FIG. 9 is a side elevational view of the support member of FIG. 7 as mounted in the head box.
FIG. 10 is a bottom view of the support member illustrated in FIG. 7.
FIG. 11 is an exploded rear perspective view of the support member and a support bar shown in FIG. 7.

As shown in FIGS. 6 and 11, the support bar 1 has a pair of attachment slots 15 defined in the lower wall 1*a* and extending from a rear edge therof toward the front side wall 1*b*. Each of the attachment slots 15 has a pair of tapered guides 15*a*, 15*a* at an open end thereof.

Figure 5:
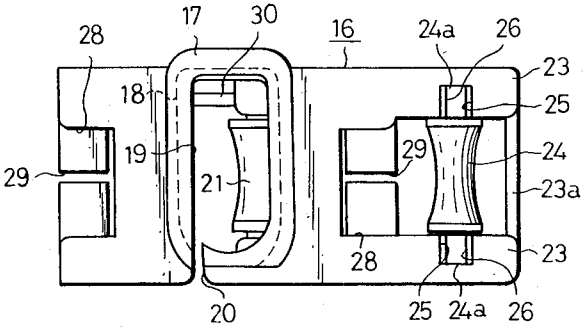
FIG. 5 is a bottom view of the support member illustrated in FIG. 2.

As shown in FIG. 6, a support member 16 made of synthetic resin engages in one of the attachment slots 15 so as to be housed in the head box 3. The support member 16 has an annular attachment 17 projecting from a bottom thereof and including an upper half portion serving as a neck 18 as shown in FIG. 5. The support member 16 is mounted in the head box 3 by inserting the neck 18 in the attachment slot 15.

Figure 2:
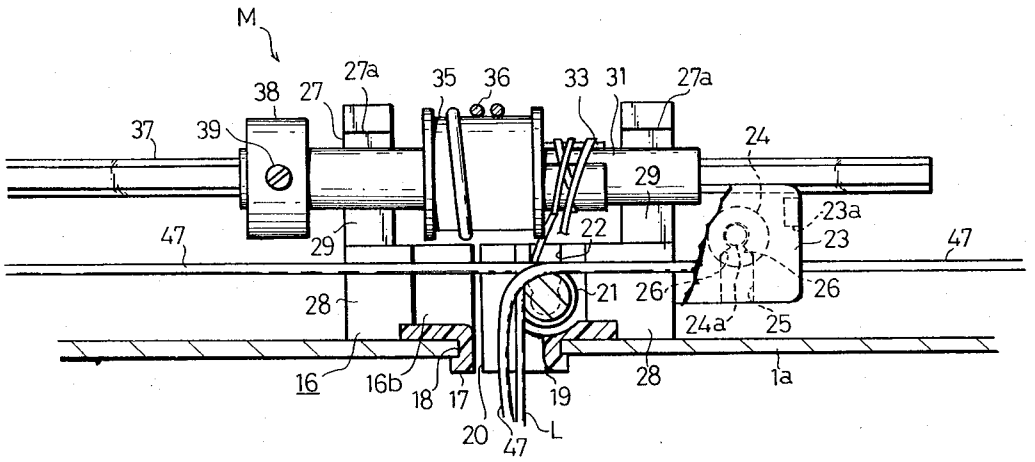
FIG. 2 is a front elevational view of one support member in a head box of the venetian blind shown in FIG. 1.

In FIGS. 2 and 5, the attachment 17 has a through insertion hole 19 communicating with the exterior through a slit 20 opening toward the open end of the attachment slot 15. The ladder cord L and a pair of slat lift cords 47 (described later) can be introduced into the insertion hole 19 from a position in front of the support member 16.

Figure 3:
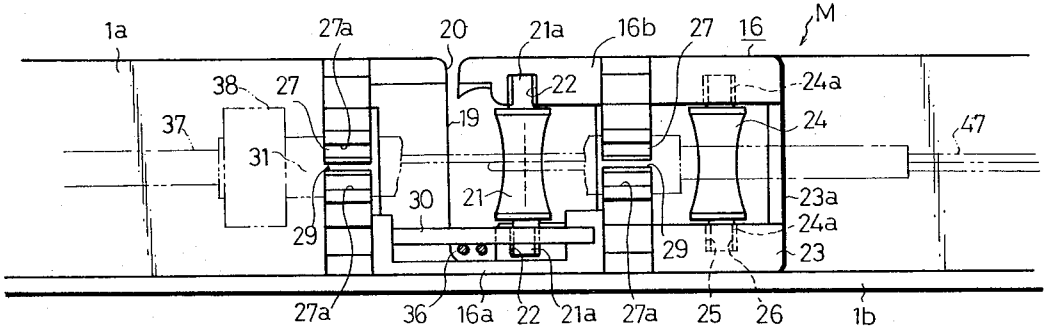
FIG. 3 is a plan view of the suppor member of FIG. 2.

As shown in FIGS. 2 and 3, a guide roller 21 for guiding the slat lift cords 47 is rotatably disposed between front and rear side walls 16*a*, 16*b* of the support member 16 and positioned slightly obliquely upwardly of the insertion hole 19 (obliquely to the right above the insertion hole 19 as shown in FIG. 2). The guide roller 21 has a shaft 21*a* removably supported in bearing slots 22, 22 defined in the side walls 16*a*, 16*b*, respectively.

A pair of projections 23, 23 projects from an end (righthand as shown in FIGS. 2 and 3) of the support member 16 in spaced-apart relation. The projections 23, 23 have ends interconnected by a connector 23*a*.

A guide roller 24 for guiding the slat lift cords 47 is rotatably disposed between the projections 23, 23 at a position slightly upward of the guide roller 21. The guide roller 24 has a shaft 24*a* supported in bearing slots 25, 25 defined in the projections 23, 23 and extending from lower edges thereof. The shaft 24*a* is removably retained between the upper end of each bearing slot 25 and shaft stops 26 that are spaced from each other by a distance smaller than the diameter of the shaft 24*a*.

As illustrated in FIG. 6, a pair of bearings 27, 27 projects upwardly from lateral opposite ends of the support member 16, there being through holes 28 defined in opposite end walls of the support member 16 below the bearings 27, 27. These through holes 28 communicate with the exterior through slits 29 defined below the bearings 27, respectively for passage therethrough of the lift cords 47 into the through holes 28 from above the support member 16. Locking projections 27*a* extend inwardly from upper portions of the bearings 27 to prevent a support shaft 31 (described later) from being easily displaced from the bearings 27.

As shown in FIGS. 4 and 6, a guide rod 30 extends laterally at a front portion of the support member 16 and is positioned slightly upwardly of the guide roller 21.

Figure 15:
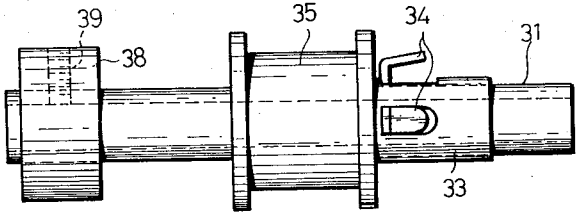
FIG. 15 is a front elevational view showing a support shaft and a drum and a sleeve mounted on the support shaft.
Figure 16:
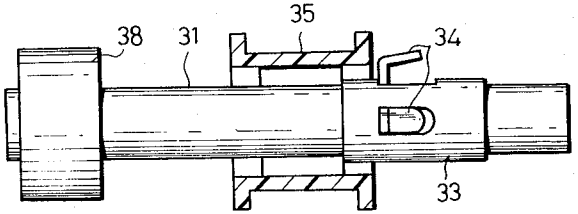
FIG. 16 is a view similar to FIG. 15, showing the drum in cross section.

In FIGS. 2 and 4, a support shaft 31 of synthetic resin for tilt adjustment of the ladder cord L is rotatably journalled in the bearings 27, 27 of the support member 16. When the support shaft 31 is moved upwardly from the bearings 17 into engagement with the locking projections 27*a* under a force greater than a prescribed force, the locking projections 27*a* are forcibly spread apart from each other by the support shaft 31 until the latter can be removed from the bearings 27. As shown in FIGS. 15, a metal sleeve 33 is fitted over an end (righthand as shown in FIG. 2) of the support shaft 31 and has a plurality of fingers 34 cut out of the sleeve 33. The ladder cord L has an upper end wound around the fingers 34 to force the latter down against the support shaft 31.

A drum 35 is integrally formed with a central portion of the support shaft 31, with a portion of a slat tilt adjustment cord 36 being wound around the drum 35 as shown in FIG. 2. The slat tilt adjustment cord 36 has opposite end portions hanging through the insertion hole 19 in the support member 16 downwardly of the head box 3 as illustrated in FIGS. 1 and 4. By pulling either one of the end portions of the slat tilt adjustment cord 36, the drum 35 rotates clockwise or counterclockwise to cause the ladder cord L wound on the support shaft 31 to adjust the angle of tilt of the slats S.

As shown in FIG. 2, a drive shaft 37 has one end fitted in the support shaft 31 and is prevented from being pulled out of the latter by a ring 38 attached to the lefthand end of the support shaft 31 and a setscrew 39 extending through the ring 38 and the support shaft 31.

In FIGS. 7 through 10, a support member 40 of synthetic resin engages in the other attachment slot 15 so as to be accommodated in the head box 3. The support member 40 is similar in construction to the support member 16, but has no projections 23, no connector 23*a*, no guide roller 24, and no guide rod 30. Identical parts of the support member 40 are denoted by identical reference characters for the support member 16, and will not be described.

A support shaft 41 of synthetic resin is rotatably supported between the bearings 27, 27 of the support member 40, the drive shaft 37 having an opposite end fitted centrally in the support shaft 41. As with the support shaft 31, the support 41 can be removed upwardly from the bearings 27 past the locking projections 27*a* when a certain force is applied. A metal sleeve 43 is fitted over the support shaft 41 and has fingers (not shown) identical to those on the sleeve 32 on the support shaft 31. These fingers are held down against the support shaft 41 by an upper end of the ladder cord L wound thereon.

The support members 16, 40, the support shafts 31, 41 and the drive shaft 37 jointly constitute the slat tilt adjustment device M.

As illustrated in FIG. 1, a lift cord locking device 44 is mounted in an attachment aperture 45 formed in a front corder of the support bar 1 at a righthand end thereof. The lift cord locking device 44 is composed of a guide roller (not shown) and a locking roller 46 coacting with the guide roller for clamping the lift cords 47.

The pair of lift cords 47 for lifting and lowering the slats S have end portions extending through the lift cord locking device 44 and the attachment aperture 45 and hanging downwardly of the head box 3. One of the lift cords 47 has an opposite end portion extending below the guide roller 24 in the support member 16, through the holes 28, over the guide roller 21, and through the insertion hole 19 and hanging downwardly of the head box 3. The end portion of the lift cord 47 then extends through righthand ends of the slats S and is connected to an end of a bottom rail 48. The other lift cord 47 has an opposite end portion extending through the holes 28 in the support member 16, over the guide roller 21 in the support member 40, and through the insertion hole 19 and hanging downwardly of the head box 3. The end portion then extends through lefthand ends of the slats S and is connected to an opposite end of the bottom rail 48.

Figure 18:
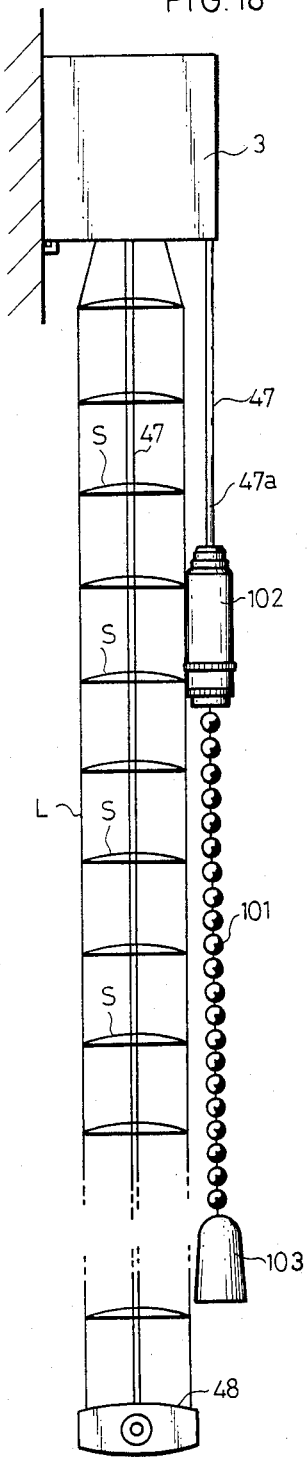
FIG. 18 is a fragmentary side elevational view of the venetian blind shown in FIG. 1.

As shown in FIG. 18, a ball chain 101 is connected by a connector 102 to lower ends 47*a* of the lift cords 47 and supports a control knob 103 on its lower end. The connector 102 has a length greater than the distance between two adjacent slats and a diameter larger than that of the ball chain 101. When the slats S extend horizontally, they have side edges held in engagement with an outer peripheral surface of the connector 102 to avoid abutment against the ball chain 101.

With the lift cords 47 connected at the lower ends to the ball chain 101 manipulatable by hand, the lift cords 47 are prevented from being smeared with finger dirt. Any dirt or dust attached to the ball chain 101 can easily be wiped away by a piece of cloth, for example. Since the ball chain 101 serves as a weight, the lift cords 47 are prevented from being moved around by winds and also from being entangled with the slat tilt adjustment cord 36 and the slats S. Because the outer peirpheral surface of the connector 102 engages side edges of the slats S to prevent the ball chain 101 from abutting against the slats S when the slats S are held horizontally, the ball chain 101 does not interfere with the slats S when the latter are adjusted in the angle of tilt.

The head box 3 and the slat tilt adjustment device M of the foregoing construction will be assembled as follows: As shown in FIGS. 6 and 11, at the time the support bar 1 and the cover bar 2 are disassembled from each other, the necks 18 of the support members 16, 40 are inserted into the attachment slots 15 in the support bar 1. At this time, the slits 20 are aligned with the open ends of the attachment slots 15.

The slats S are attached to the lift cords 47 and the ladder cords L with their lower ends secured to the ends of the bottom rail 48, and the upper ends of the ladder cords L are fixed to the sleeves 33, 43, respectively, on the support shafts 31, 41 on the opposite ends of the drive shaft 37.

The upper portions of the ladder cords secured to the support shafts 31, 41 and the corresponding portions of the lift cords 47 are inserted through the slits 20 into the insertion holes 19 in the support members 16, 40. Then, the lift cord 47 from the support member 40 is threaded through the slit 29 (FIG. 7) in the righthand end of the support member 40 and the slits 29 (FIG. 2) in the opposite ends of the support member 16 into the holes 28 in the support members 40, 16, and then is disposed below the guide roller 24 in the support member 16.

The lift cord 47 from the support member 16 is threaded through the slit 29 (FIG. 2) in the righthand end of the support member 16 into the hole 28 therein, and is positioned below the guide roller 24 in the support member 16. Then, the lift cords 47 from the support members 16, 40 are passed through the lift cord locking device 44, and depend downwardy from the support bar 1 as shown in FIG. 1.

Figure 7:
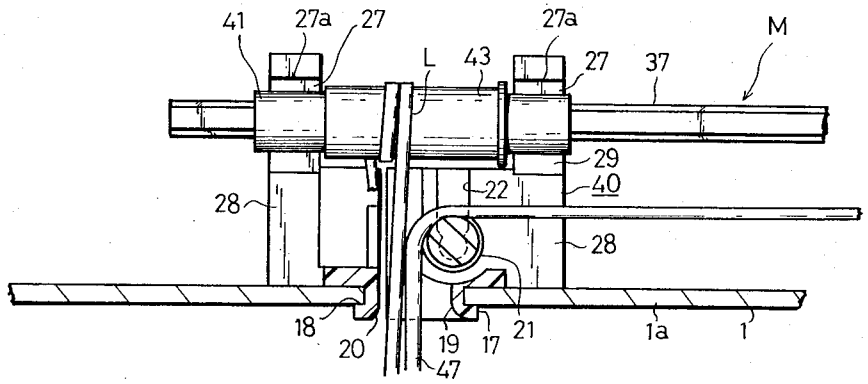
FIG. 7 is a front elevational view of another support member in the head box.
Figure 8:
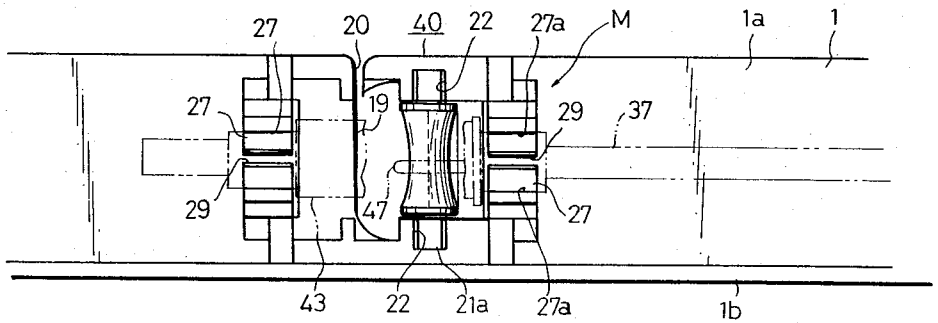
FIG. 8 is a plan view of the support member of FIG. 7.

After the lift cords 47 have passed through the holes 28 in the support members 16, 40, the support shafts 31, 41 are fitted from above into the bearings 27, respectively, on the opposite ends of the support members 16, 40 (See FIGS. 2 and 7). At this time, the support shafts 31, 41 are temporarily engaged by the locking projections 27*a* above the bearings 27. By applying a force greater than a certain force to the support shafts 31, 41, they are forced into the bearings 27 as the locking projections 27*a* are resiliently spread apart from each other. After the support shafts 31, 41 have been fitted in the bearings 27, the locking projections 27*a* spring back under their own resiliency to prevent the support shafts 31, 41 from being disengaged from the bearings 27.

Thereafter, the ends of the adjustment cord 36 wound around the drum 35 are inserted through the insertion hole 19 across the rear side of the guide rod 30 in the support member 16 and are allowed to depend from the support bar 1, as illustrated in FIGS. 1, 3 and 4.

The ridges 6, 4 on the support bar 1 are then longitudinally fitted into the grooves 7, 5*a*, respectively, in the cover bar 2 (See FIGS. 4 and 9). Then, as shown in FIGS. 1 and 13, the plugs 8 are fitted into the ends of the head box 3 with the ridge 5 engaging in the recess 11 until the projections 13 on the locking tongues 12 snapped into the holes 14 in the support bar 1. The plugs 8 are then retained in the head box 3 against removal.

Since the support bar 1 have no upper and rear side walls as shown in FIGS. 6 and 11, the slat tilt adjustment device M can easily be mounted on the support bar 1.

With the attachment aperture 45 for the lift cord locking device 44 being defined in the front corner of the support bar 1, the lift cord 47 for raising and lowering the slats S can depend obliquely downwardly from the head box 3 so that the lift cord 47 can be manipulated easily in front of the slats S without being disturbed thereby.

The head box 3 is of an enclosed construction composed of the support bar 1, the cover bar 2 and the plugs 8, so that no dirt, dust or foreign matter will find its way into the head box 3.

The rear side wall 1*d* of the cover bar 2 of the head box 3 has a downward extension as shown in FIGS. 1 and 4 for preventing rays of light such as sunlight from entering between the lower edge of the cover bar 2 and the uppermost slat S into the room when the slats S are tilted through a maximum angle.

Figure 19:
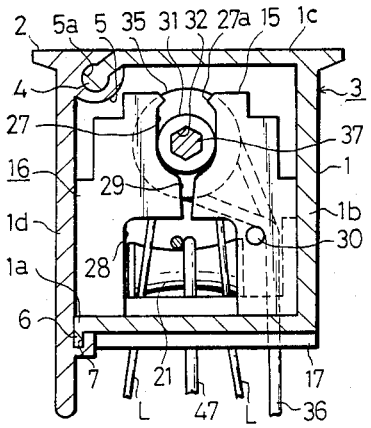
FIG. 19 is a cross-sectional view of another head box.

As shown in FIG. 19, a head box 3 may be composed of a cross-sectionally channel-shaped support bar 1 having no rear side wall and a cover bar 2 covering the rear opening in the support bar 1.

The support bar 1 has an upper longitudinal ridge 4 formed on and extending along a rear edge of an upper wall 1*c*, and the cover bar 2 has on an upper edge thereof an upper groove 5*a* receiving therein the upper longitudinal ridge 4 on the support bar 1.

The support bar 1 also has a lower wall 1*a* having attachment slots 15 defined therein and extending from a rear edge thereof. The support members 16, 40 of the slat tilt adjustment device M can be mounted on the support bar 1 simply by being inserted into the attachment slots 15 in a single operation. After the cover bar 2 has been attached to the support bar 1 by being fittingly slid thereover from one end thereof, the support members 16, 40 are retained in the attachment slots 15 against accidental removal.

A head box 3 according to still another embodiment will be described with reference to FIGS. 20 through 23.

Figure 22:
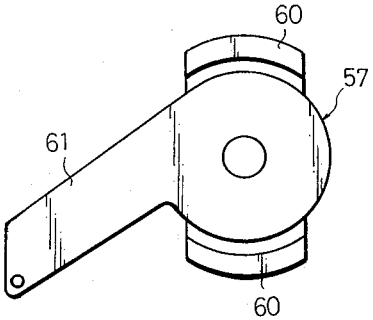
FIGS. 22 and 23 are plan and side elevational views of the attachment shown in FIG. 20.
Figure 21:
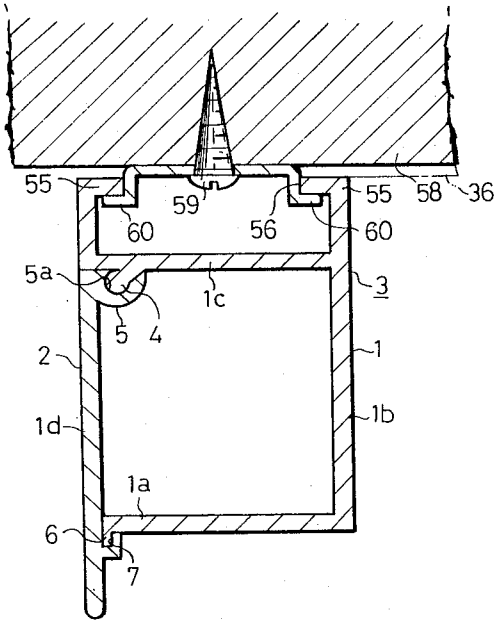
FIG. 21 is a cross-sectional view taken along line XXI—XXI of FIG. 20.
Figure 23:
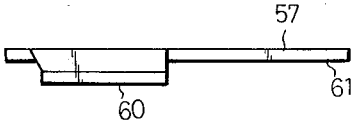
Figure 25:
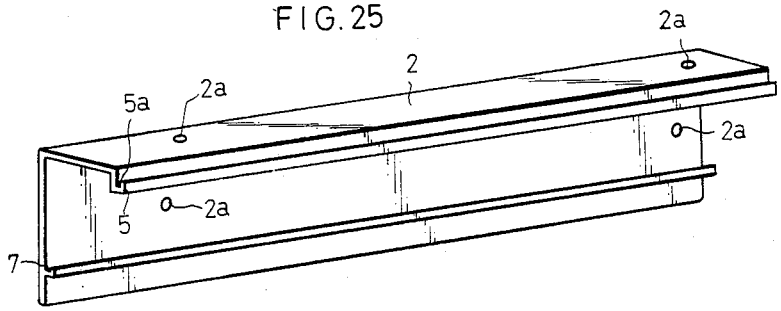
FIG. 25 is a perspectivew view, on a reduced scale, of a cover bar of the head box shown in FIG. 24.

As illustrated in FIG. 21, a support bar 1 includes an upper wall 1*c* from which a pair of locking projections or brackets 55 extends upwardly on front and rear edges of the upper wall 1*c*. The locking projections 55 have upper edges bent toward each other and defining a support groove 56 therebetween. The head box 3 is mounted on an upper window frame 58 by an attachment 57 engaging in the support groove 56 as shown in FIGS. 22 and 23.

The attachment 57 has an end angularly movably attached by a screw 59 to the upper window frame 58. The attached end of the attachment 57 includes a pair of locking tongues 60, 60 projecting outwardly away from each other and having an L-shaped cross section. By turning the attachment 57 inserted in the support groove 56 through about 90 degrees, the locking tongues 60 are brought into locking engagement with the locking projections 55. The attachment 57 also includes a lever 61 extending obliquely from the end thereof fastened to the upper window frame 58.

Figure 20:
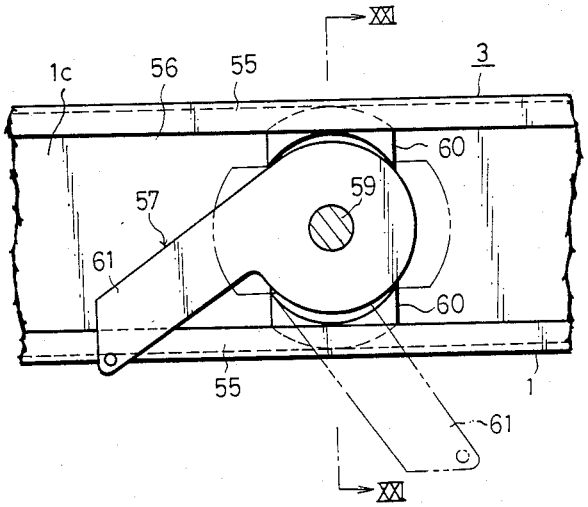
FIG. 20 is a bottom view of the head box mounted by an attachment on an upper window frame.

For attaching the head box 3 to the upper window frame 58, the attachment 57 is secured by the screw 59 to the upper window frame 58 with the locking tongues 60 directed longitudinally of the direction in which the head box 3 is to be mounted, as shown by the two-dot-and-dash lines in FIG. 20. The head box 3 with the support bar 1 and the cover bar 2 assembled together is brought toward the upper window frame 58 in alignment with the direction of attachment, and the screwed end of attachment 57 is placed in the support groove 56. Thereafter, the attachment 57 is turned with the lever 61 to the solid-line position of FIG. 20, thus causing the locking tongues 60 to be engaged by lower surfaces of the locking projections 55 of the head box 3. The head box 3 is thus mounted on the upper window frame 58.

Figure 24:
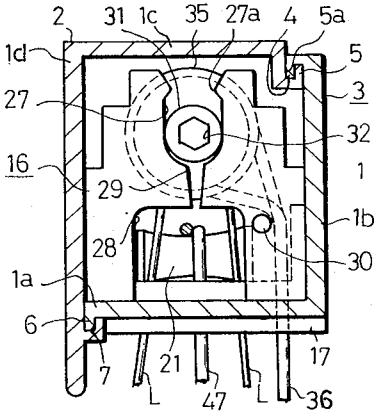
FIG. 24 is a cross-sectional view showing a head box according to still another embodiment.

As illustrated in FIG. 24, the upper wall 1*c* of the cover bar 2 may have an upper groove 5*a* identical in shape to the lower groove 7 and the support bar 1 may have on its upper edge an upper ridge 4 fitted in the upper groove 5*a*.

Figure 26:
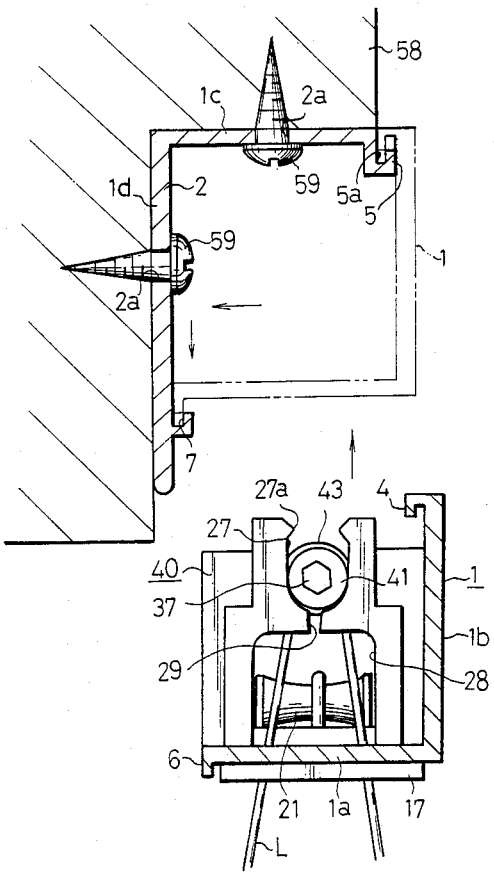
FIG. 26 is a cross-sectional view illustrative of the manner in which the head box of FIG. 24 is installed in place.
Figure 28:
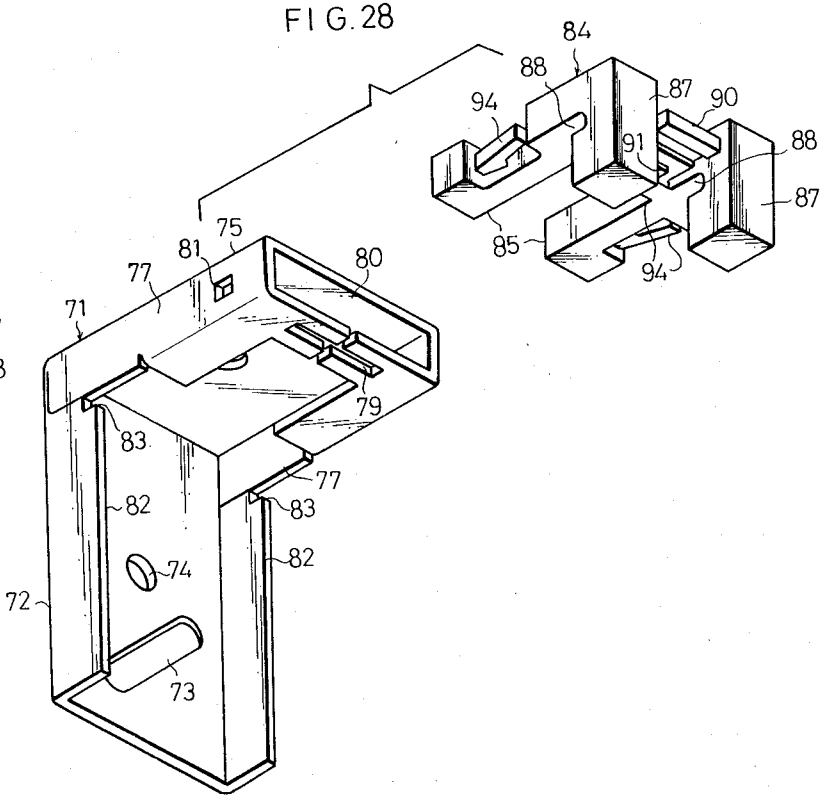
FIG. 28 is an exploded perspective view of the attachment of FIG. 27, showing an attachment body and a support member.
Figure 27:
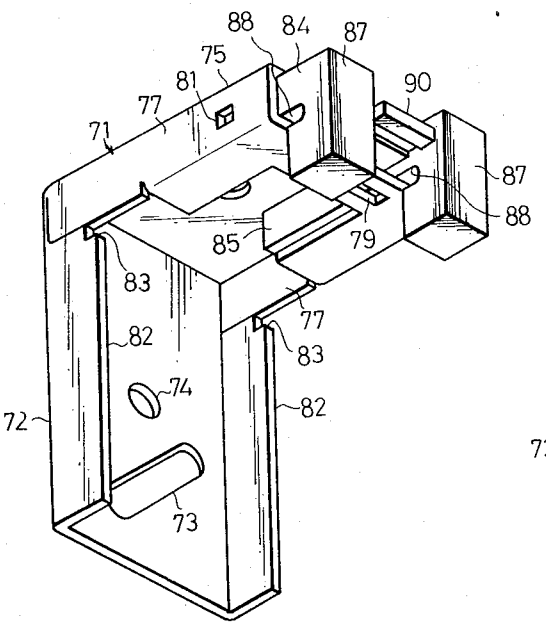
FIG. 27 is a perspective view of an attachment for supporting the head box.

The head box 3 shown in FIG. 24 can be attached to an upper window frame 58 in the manner as shown in FIG. 26. The cover bar 2 is mounted in advance on the upper window frame 58 by screws 59 extending through holes 2*a* in upper and rear side walls 1*c*, 1*d*, and the support bar 1 with the slat tilt adjustment device M installed thereon is brought upwardly slightly displaced to the right out of vertical alignment with the cover bar 2. Then, the support bar 1 is positioned as shown by the two-dot-and-dash lines in FIG. 26 and the ridges 4, 6 are fitted from above into the grooves 5*a*, 7, respectively.

With the foregoing construction, the cover bar 2 can be directly attached to the upper window frame 58, and the support bar 1 is mounted on the cover bar 2 thus secured to the upper window frame 58. Therefore, the head box 3 can be dispensed with any brackets or locking projections for attaching the head box 3 to the upper window frame 58. Since the support bar 1 can easily be affixed to the cover bar 2, the venetian blind can be mounted on the upper window frame 58 with utmost ease.

An attachment for attaching the head box as illustrated in FIGS. 1 through 19 to a wall above a window or a ceiling will be described with reference to FIGS. 27 through 30.

An attachment 71 is in the form of an angle bracket of metal and includes a vertical member 72 having holes 73, 74 for receiving screws to fasten the attachment 71 to a wall above a window, for example. The attachment 71 also includes a horizontal member 75 having a pair of ribs 77, 77 bent downwardly from side edges thereof. The horizontal member 75 has a tubular distal end 80 with a locking groove 79 defined in a lower surface thereof. The ribs 77 have engagement holes 81 adjacent to the tubular distal end 80. The vertical member 72 has a pair of ribs 82 bent forward from side edges thereof and including a pair of recesses 83, respectively, for supporting the head box 3.

A support member 84 made of synthetic resin has a pair of legs 85 each including a projection 87 extending downwardly from a distal end thereof and having a recess 88 defined a rear side surface of the projection 87 and confronting one of the recesses 83. A locking member 90 is disposed between the projections 87 and has a downward projection 91. The legs 85 have stop projections 94, respectively, on their outer side surfaces. The stop projections 94 have distal ends engageable in the holes 81 in the attachment 71 for preventing the support member 84 from being dislodged completely out of the attachment 71.

Figure 30:
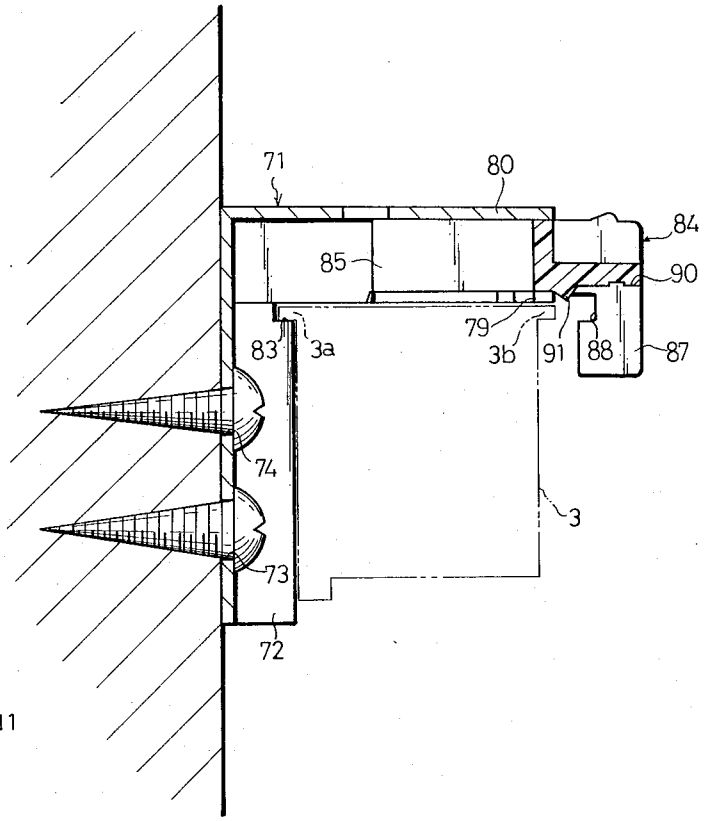
FIG. 30 is a cross-sectional view showing the way in which the head box is mounted by the attachment of FIG. 27.

When the attachment 71 is to be used, the attachment 71 is secured to a wall surface, for example, by screws fastened through the holes 73, 74 in the vertical member 72 as illustrated in FIG. 30.

Figure 29:
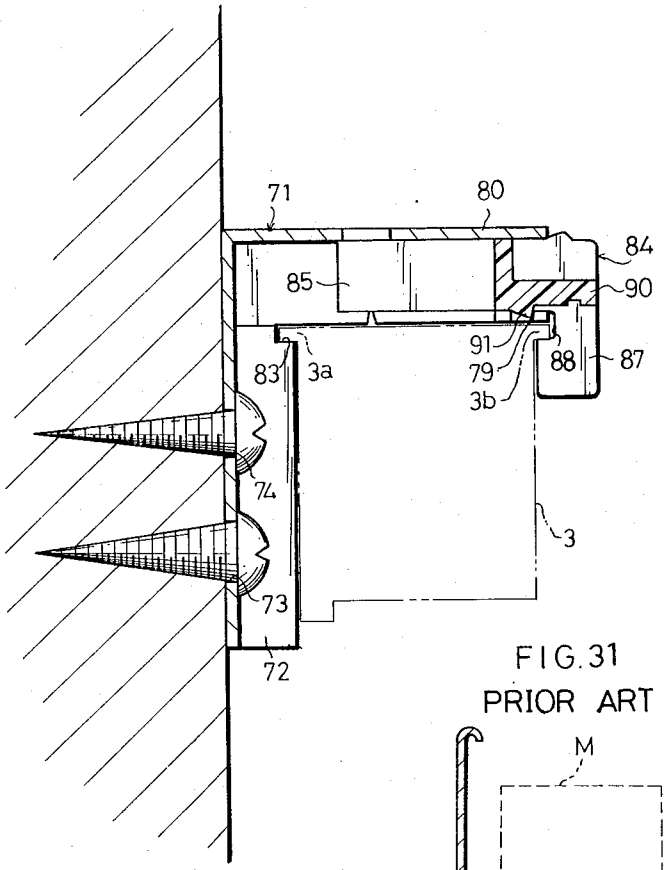
FIG. 29 is a cross-sectional view of the head box mounted by the attachment of FIG. 27.
Figure 31:
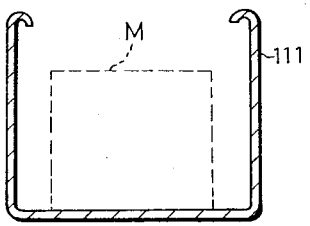
FIG. 31 PRIOR ART
FIG. 31 is a cross-sectional view of a conventional head box.

Then, the support member 84 is inserted into the tubular end 80 of the attachment 71 until the legs 85 enter the latter up to substantially central portions thereof, and an upper rear ridge on the head box 3 is fitted in the recesses 83 in the attachment 71. Thereafter, the support member 84 is further inserted into the attachment 71 until the locking projection 91 on the locking member 90 is snapped in the locking groove 79 in the attachment 71, as shown in FIG. 29. At this time, an upper front ridge 3*b* on the head box 3 is fitted in the recesses 88 in the support member 84. The head box 3 is now fixed in position on the wall. With this arrangement, the head box 3 can be mounted on the wall with utmost ease.

For removing the head box 3 from the wall, the locking member 90 is pushed upwardly to disengage the locking projection 91 from the locking groove 79. Then, the support member 84 is pulled forward, and the head box 3 can now be easily detached from the attachment 71. Since the stop projections 94 on the sides of the support member 84 are retained respectively in the holes 81 in the attachment 71 at this time, there is no danger of accidental dislodgment of the support member 84 from the attachment 71. Therefore, it is easy to attach the head box 3 again to the attachment 71.

With the foregoing arrangement of the invention, the slat tilt adjustment device and other components can easily be attached in position, and the assembled head box is highly resistant to entry of dust, dirt or other foreign matter.

Although certain preferred embodiments have been shown and described, it should be understood that many changes and modifications may be made therein without departing from the scope of the appended claims.

What is claimed is:

1. A venetian blind comprising:

(a) a head box having a rectangular tubular cross section composed of an elongated support bar including at least a front side wall and a lower wall and having an open side, an elongated cover bar attached to said support bar with a plurality of interfitting joints in covering relation to said open side of said support bar;

(b) a multiplicity of horizontal slats arranged in vertically spaced relation and positioned downwardly of said head box;

(c) a slat tilt adjustment device accommodated in said head box for adjusting the angle of tilt of said slats, which comprises a plurality of support members disposed in said head box and spaced from each other longitudinally of said head box, an elongated rotatable drive shaft extending between and having portions journalled by said support members, said support member having insertion holes for extending ladder cord through them and slits positioned behind said insertion holes in communication therewith for introducing said ladder cords into said insertion holes; and (d) said lower wall of said support bar includes a plurality of attachment recesses extending from a rear edge thereof and each of said support members has a lower neck portion for slidable engagement with one of said attachment recesses from said rear edge, thereby allowing said ladder cords to extend through said head box.

2. A venetian blind according to claim 1, wherein said support and cover bars are substantially L-shaped in cross section and assembled together in mutually inverted relation.

3. A venetian blind according to claim 2, wherein said head box has front and rear side walls and upper and lower walls, said front side wall and said lower wall of said support bar constituting said front side wall and said lower wall, respectively, of said head box, said cover bar having a rear side wall and an upper wall constituting said rear side wall and said upper wall, respectively, of said head box.

4. A venetian blind according to claim 3, wherein said rear side wall and/or said upper wall of said cover bar have holes for insertion through which a plurality of screws to attach said cover bar to an upper window frame.

5. A venetian blind according to claim 1, wherein said support and cover bars are L-shaped in cross section.

6. A venetian blind according to claim 5, wherein said head box has front and rear side walls and upper and lower walls, said support bar constituting said front side wall, said upper wall and said lower wall of said head box, and said cover bar constituting said rear side wall of said head box.

7. A venetian blind according to claim 6, wherein said upper wall of said support bar has a pair of brackets projecting upwardly from front and rear edges thereof and having upper edges bent toward each other.

8. A venetian blind according to claim 3 wherein interfitting joints extend longitudinally the entire length of said support and cover bars so that they are joined to each other to form said head box.

9. A venetian blind according to claim 8, wherein each of said interfitting joints comprise a ridge, fitted in a complementary groove.

10. A venetian blind according to claim 9, wherein a first pair of said ridge and said groove are substantially circular in cross section and mutually slidable in interfitting engagement longitudinally of said support and cover bars, and a second pair of said ridge and said groove with said groove of said second pair having a rectangular cross section.

11. A venetian blind according to claim 1, including lift cords movably supported by said support members for vertically moving said slats.

12. A venetian blind according to claim 11, wherein said support members being mounted on said lower wall of said support bar and said support members having bearings thereon in which said drive shaft is journalled.

13. A venetian blind according to claim 12, wherein said support members have holes defined below said bearings, said lift cords extending through said holes, and slits defined through bottoms of said bearings in communication with said holes for introducing therethrough said lift cords into said holes from above said slits.

14. A venetian blind according to claim 1, including a pair of plugs mounted in opposite open ends of said head box in covering relation to said opposite open ends, said head box having engagement portions, said plugs including locking members held in locking engagement with said engagement portions, respectively.

15. A venetian blind according to claim 14, wherein said engagement portions of said head box comprise holes, said locking members of said plugs comprising projections engaging respectively in said holes.

16. A venetian blind according to claim 5, wherein said interfitting joints extend longitudinally the entire length along which said support and cover bars are joined to each other.

17. A venetian blind according to claim 16, wherein each of said interfitting joints comprise a ridge fitted in a complementary groove.

18. A venetian blind according to claim 17, wherein a first pair of said ridge and said groove are substantially circular in cross section and mutually slidable in interfitting engagement longitudinally of said support and cover bars, and a second pair of said ridge and said groove with said groove of said second pair having a rectangular cross section.

* * * * *